US006009589A

United States Patent [19]

Driesen et al.

[11] Patent Number: 6,009,589

[45] Date of Patent: Jan. 4, 2000

[54] BRUSH SECTION FOR A TOOTHBRUSH

[75] Inventors: Georges Driesen, Weilrod; Peter Hilfinger, Bad Homburg, both of Germany

[73] Assignee: Braun Aktiengesellschaft, Germany

[21] Appl. No.: 08/553,603

[22] PCT Filed: Apr. 27, 1996

[86] PCT No.: PCT/EP94/01326

§ 371 Date: Nov. 14, 1995

§ 102(e) Date: Nov. 14, 1995

[87] PCT Pub. No.: WO94/27467

PCT Pub. Date: Dec. 8, 1994

[30] Foreign Application Priority Data

May 26, 1993 [DE] Germany ..... 43 17 407

[51] Int. Cl.[7] ..... A46B 9/04

[52] U.S. Cl. ..... 15/167.1; 15/190; 15/195; 15/199; 15/205

[58] Field of Search ..... 15/167.1, 190, 15/195, 199, 205

[56] References Cited

U.S. PATENT DOCUMENTS

| | | | |
|---|---|---|---|
| 423,506 | 3/1890 | Young | 15/190 |
| 2,130,244 | 9/1938 | Nishio | 15/190 |
| 2,289,313 | 7/1942 | Cave | 15/199 |
| 2,303,470 | 12/1942 | Jobst | 15/190 |
| 3,857,134 | 12/1974 | Wells | 15/199 |

FOREIGN PATENT DOCUMENTS

| | | |
|---|---|---|
| 0 357 852 A1 | 3/1990 | European Pat. Off. . |
| 0 289 059 B1 | 1/1993 | European Pat. Off. . |
| 31 05 544 A1 | 6/1982 | Germany . |
| 41 01 515 A1 | 7/1992 | Germany . |
| 2 088 710 | 3/1981 | United Kingdom . |
| 2 135 193 | 2/1983 | United Kingdom . |
| 2 247 400 | 5/1991 | United Kingdom . |

OTHER PUBLICATIONS

International Search Report mailed Nov. 4, 1994.

Japanese Abstract, JP910228394, dated Feb. 2, 1993.

*Primary Examiner*—James F. Hook

*Attorney, Agent, or Firm*—Fish & Richardson P.C.

[57] ABSTRACT

The invention is directed to a toothbrush having a brush section 20 comprising a bristle carrier 22 and bristles 24 fixedly secured thereto, with the brush section 20 being provided with components made of silver. Separate structures 28 are provided for fixedly securing the bristles 24 in their proper location in the bristle carrier 22, which separate structures 28 are made of a material with oligodynamic action.

17 Claims, 1 Drawing Sheet

BRUSH SECTION FOR A TOOTHBRUSH

Figure 2:
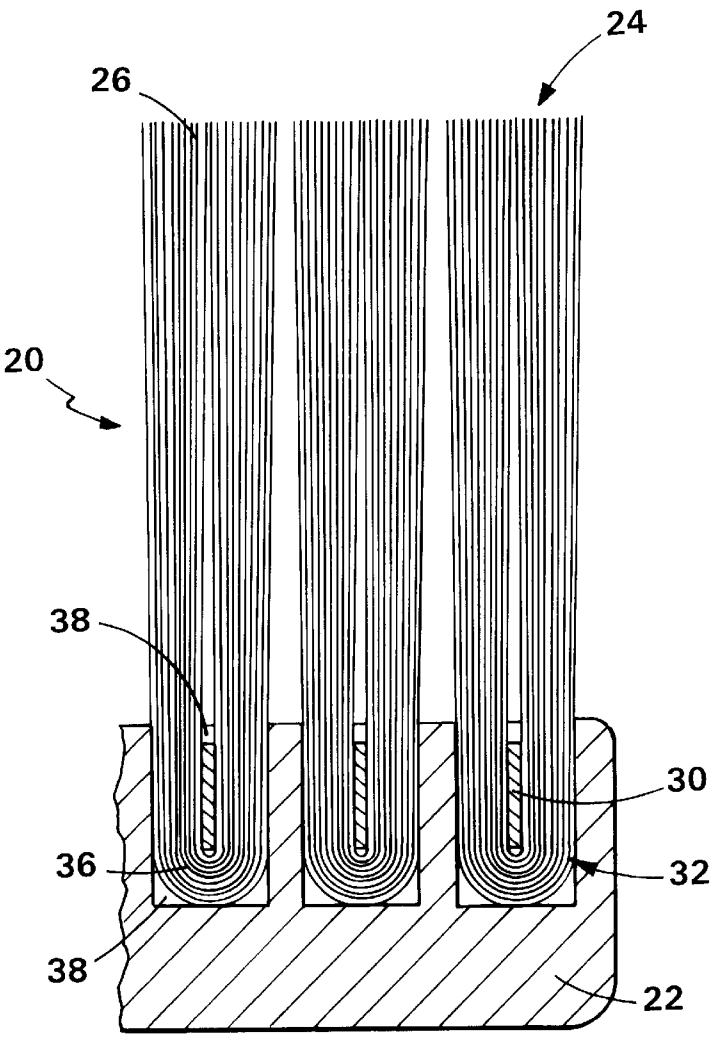

This invention relates to a toothbrush having a brush section comprising a bristle carrier and bristles fixedly secured thereto, with the brush section being provided with components made of a material with oligodynamic action.

A brush section of this type is known in the art from DE 31 05 544 A1. Prior to fitting the bristles, the bristle carrier of this brush section is plated with an adherent silver coating using an electroplating process. Silver-coating the bristle carrier is intended to prevent the adhesion of contaminants and, above all, the formation of bacteria. It is a disadvantage in this process that coating the bristle carrier surface with silver does not produce the desired germicidal effect particularly in that portion of the bristles that is received within the bristle carrier. By reason of the capillary action, this portion is exposed to humidity practically all the time, so that it can dry up very poorly only. In addition, silver-coating the complete bristle carrier is a costly and laborious procedure.

Other techniques aimed at avoiding the formation of, or reducing an already existing, bacterial flora on the brush section, in particular between the individual bristles, include, for example, an exposure of the brush to ultraviolet radiation. While this method requires an extra effort from its user, it is time-consuming and also incurs added cost for the radiation apparatus.

Further, from EP 0 357 852 a toothbrush is known in which the area in which the bristles are mounted is configured such as to enable an ionic current to flow in this particular area. The source of the ionic current is a battery accommodated in the toothbrush.

It is therefore an object of the present invention to improve upon the known toothbrush such as to obtain a toothbrush which is essentially free from bacteria/germs and is maintained in this condition during use, without necessitating added manufacturing expense.

This object is accomplished in that separate means are provided for fixedly securing the bristles in their proper location in the bristle carrier, and that said separate means are made of the material with oligodynamic action.

Oligodynamic action is generally understood to be the action of very small quantities of metal ions, especially a growth-inhibiting or destructive action of heavy metal traces on microorganisms, with the oligodynamic action of the metals diminishing in the following order: Cadmium—silver—brass—copper—mercury. Cadmium has the highest, mercury the lowest oligodynamic action. This oligodynamic action has been utilized in particular for the disinfection and preservation of liquids, particularly for the disinfection of drinking, pool and service water. Especially suitable for this purpose are silver and its compounds. The silver ions which go into solution relatively sparingly on contact with water attach themselves to the negative charge carriers of the bacterium cells as positive ions. This attachment is followed by irreversible damage to the bacterium cells, that is, a bactericidal action results. The reason for this is the fouling of certain enzymes by the metal ions, which interferes with the metabolism of the bacteria, ultimately killing the bacterium cells. Of equal importance is the fungicidal action of silver, killing, for example, mold fungi. Such reactions set in from a silver concentration of as low as about 5 micrograms per liter of water, which is far below the tolerance limit for the human organism. Below this limit, a bacteriostatic and/or fungistatic condition prevails, that is, any further bacterial and/or fungal growth is inhibited. By reason of the use of a material with oligodynamic action as a separate means for positioning the bristles in their proper location relative to the bristle carrier, the formation of bacteria is avoided especially in this poorly drying and thus problematic area. Due to chemical diffusion, an essentially germ-free zone is also obtained in a bristle portion above the bristle carrier. By this means, a germ-free toothbrush is provided without involving the added use of chemical or other substances. This practically precludes infections, as in the gingival area, which may occur when a bacteria-infested toothbrush is used. The use of these separate means of the invention made of a material with oligodynamic action has no effect on the manufacturing method or the tools to be employed, so that the manufacturing techniques so far applied can be maintained unchanged.

Advantageously, the separate means for fixedly securing the bristles within bores in the bristle carrier are configured as small anchoring plates arranged in particular approximately centrally between the individual bristles of a bristle tuft and anchored in areas of the bristle carrier adjoining the respective bores. Fixedly securing the bristles within the bores by means of the anchoring plates is performed by a method known per se. In this method (see, for example, EP 0 289 059 B1), the bristles are fitted to the bristle carriers of the toothbrushes by means of a tufting machine. Bent in a U-shaped configuration, the bristle tufts are inserted into the bore and retained therein by introducing (driving) the anchoring plate into the bore. This thus enables a material with oligodynamic action to be used on any toothbrush in which the bristles are fixedly secured in the bristle carrier by means of anchoring plates. The material of the anchoring plates takes immediate effect in the particularly critical area of the toothbrush in which bacteria accumulate and grow especially readily, that is, between the individual bristles in the bore. As a result of the capillary action, the bristles in the area of the bore are completely wetted with water during and following use of the toothbrush, which water is capable of drying up at a slow rate only, so that this area is considered the breeding ground for germs, allowing bacteria to accumulate and grow. The oligodynamic action of the material of which the anchoring plates are made kills the bacteria in this area, thus ensuring a germ-free brush.

In an advantageous feature of the present invention, the separate means are made of a material enriched with silver, preferably a silver alloy with a silver content of over 70%, approximately.

Particularly advantageously, the separate means are composed of an alloy of silver and copper with a silver content of between 90% and 97%, approximately, and a copper content of between 10% and 3%, approximately, or alternatively, of an alloy of silver and titanium with a silver content of 70%, approximately, and a titanium content of 30%, approximately. These alloys are readily suitable for use in the manufacturing method and, in addition to having the requisite tensile strength of over 500 $N/mm^2$, also have sufficient oligodynamic action.

In an advantageous further feature, the separate means are plated with a coating of essentially pure silver. The silver coating is applied to the separate means, as for example, the anchoring wire, by electroplating, so that the process-related necessary strength values of the material for the anchoring plates are ensured by the base material of the anchoring wire, while the oligodynamic action is ensured by the silver coating.

By providing the silver coating with a thickness of between 5 and 50 micrometers, in particular 5 to 20 micrometers, the desired oligodynamic action of the silver is accomplished with due consideration of an economical use of the material.

Advantageously, the separate means are made of silver with a percentage purity of over 99%, approximately, whereby an extremely high oligodynamic action is ensured. By giving the silver material a special treatment, as by cooling it with nitrogen, the strength values and processing properties necessary for application of the method are obtained, and positioning the bristles in their proper location in the bristle carrier is made possible by an anchoring plate made of silver. The requisite strength values may also be obtained by cold-forming the anchoring material.

In an advantageous embodiment of the present invention, the separate means are made of stainless steel or titanium. As well as meeting the necessary demands in respect of strength, these materials have equally a fungicidal and bactericidal action, though it is weaker.

Further advantages and application possibilities of the present invention will become apparent from subsequent descriptions of the embodiment illustrated in greater detail in the accompanying drawing.

Figure 1:
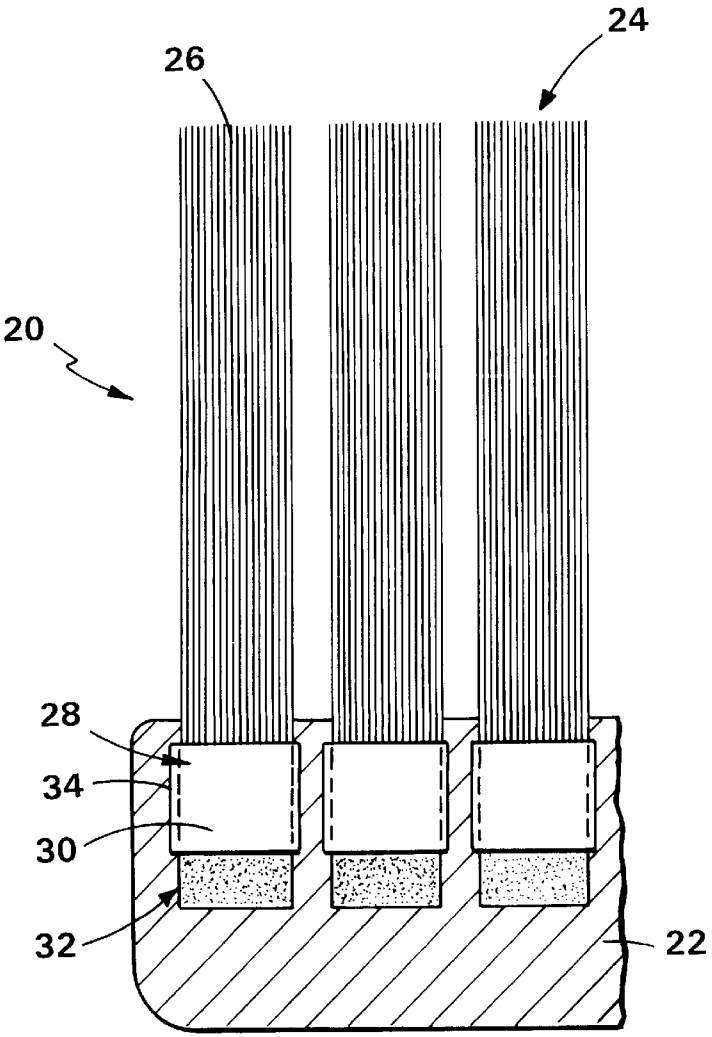

In the drawing,

FIG. 1 is a longitudinal sectional view of a brush section of the present invention; and FIG. 2 is a cross-sectional view of the brush section of FIG. 1.

Referring now to the Figures, there is shown a brush section 20 for toothbrushes having bristles 24 arranged in a bristle carrier 22 either individually or in the form of bristle tufts 26. The bristles of the tufts 26 are each bent in a U-shaped configuration and fitted into a bore 32. Positioning the bristle tufts 26 in their proper location within the bores 32 is accomplished by separate means 28 made at least in part of silver and preferably configured as small anchoring plates 30. The anchoring plates 30 are centrally arranged in the U-shaped bent portion 36 of each bristle tuft 26 and are anchored, in particular wedged in place, in areas 34 adjoining the respective bores 32. This secures the bristle tufts 26 in their proper location, preventing them from slipping out or being pulled out of their bores.

For location, the bristles 24 are bent in a U-shaped configuration and introduced into the bores 32 in the bristle carrier 22 by means of a tufting machine. Then the anchoring plate 30 is inserted centrally into the bent bristle 24 or the bristle tuft 26. Between the individual bristles 24 and/or between the bristles 24 and the bore 32, free spaces 38 are maintained which are not completely occupied by the bristles 24 or the bristle tufts 26. Considering that the capillary action between the individual bristles 24 and/or between the bristles 24 and the bores 32 causes water to accumulate in the spaces 38 during use, which dries up only very rarely between consecutive uses of the toothbrush, these spaces 38 are a breeding ground for bacteria. On contact with water, the material of the anchoring plates 30, which is at least partially composed of silver, causes silver ions to go into solution during and after use of the toothbrush. These silver ions adversely affect the metabolism of the bacteria, causing, as the metabolism collapses, the bacteria to die. Moreover, these silver ions also have a fungicidal action, that is, they equally destroy mold fungi which may deposit in the area of the bores 32 between or on the bristles 24. Silver having the property of giving off ions in solution only sparingly, the number of ions in the solution is naturally limited, yet sufficient for a bactericidal action. It is to be noted that the solution has no detrimental effect on the flora of useful bacteria in the oral cavity, because the positive silver ions react almost completely with the negative ions of the toothpaste or the saliva. The positive silver ions combine in part with the negative ions of the toothpaste or the saliva to form silver salts which precipitate from the solution and are flushed out of the oral cavity during tooth cleaning together with the rinse water. Owing to the use of anchoring plates 30 made of a material with oligodynamic action, as, for example, a silver-coated anchoring wire, the brush section 20 of the toothbrush becomes germ-free and is maintained in such condition, in spite of persistent humidity in the critical area between the individual bristles 24 and/or in the spaces 38 between the bristles 24 and the bores 32.

We claim:

1. A toothbrush comprising:

a brush section including a bristle carrier and bristles fixedly secured to the bristle carrier, and a separate member fixedly securing the bristles to the bristle carrier, said separate member being made of material with oligodynamic action.

2. A toothbrush as claimed in claim 1, wherein said bristle carrier further includes a bore, said separate member fixedly securing the bristles within the bore in the bristle carrier, said separate member configured as a small anchoring plate arranged approximately centrally between the individual bristles which together form a bristle tuft anchored in the bristle carrier.

3. A toothbrush as claimed in claim 1 or claim 2, wherein said separate member is made of a material comprising silver.

4. A toothbrush as claimed in claim 3, wherein said separate member is comprised of an alloy of silver and copper with a silver content of between 90% and 97%, approximately, and a copper content of between 10% and 3%.

5. A toothbrush as claimed in claim 3 wherein said separate member comprises a silver alloy with a silver content of at least approximately 70%.

6. A toothbrush as claimed in claim 3 wherein said separate member is comprised of an alloy of silver and titanium with a silver content of approximately 70% and a titanium content of approximately 30%.

7. A toothbrush as claimed in claim 1 or claim 2, wherein said separate member is plated with a coating of essentially pure silver.

8. A toothbrush as claimed in claim 7, wherein the silver coating has a thickness of between 5 and 50 micrometers.

9. A toothbrush as claimed in claim 8 wherein the silver coating has a thickness of between 5 and 20 micrometers.

10. A toothbrush as claimed in claim 1 or claim 2, wherein said separate member is made of silver with a percentage purity of over 99%.

11. A toothbrush as claimed in claim 1 or claim 2, wherein said separate member has a tensile strength greater than approximately of 500 $N/mm^2$.

12. A toothbrush as claimed in claim 2, wherein said separate member is comprised of stainless steel.

13. A toothbrush as claimed in claim 1 wherein said material with oligodynamic action is selected from a group consisting of cadmium, silver, brass, copper, stainless steel, titanium and mercury.

14. A toothbrush as claimed in claim 13 wherein said material with oligodynamic action is silver.

15. A toothbrush as claimed in claim 13 wherein said material with oligodynamic action is copper.

16. A toothbrush as claimed in claim 13 wherein said material with oligodynamic action is stainless steel.

17. A toothbrush as claimed in claim 1 further comprising a plurality of separate members, said bristle carrier further comprising bores, each of said separate members fixedly securing bristle tufts, each formed of a plurality of said bristles, within a corresponding bore.

* * * * *